United States Patent [19]

Anderson

[11] Patent Number: 4,984,380

[45] Date of Patent: Jan. 15, 1991

[54] BODY-MOTION ACTIVATED CRIB MOBILE

[76] Inventor: Rodney D. Anderson, 1760 Carson La., Huntsville, Ala. 35816

[21] Appl. No.: 380,604

[22] Filed: Jul. 17, 1989

[51] Int. Cl.[5] ..... G09F 27/00; A63H 30/00

[52] U.S. Cl. ..... 40/455; 446/227; 446/175; 40/473

[58] Field of Search ..... 40/473, 617, 457, 455; 446/72, 175, 227, 236, 242, 247, 210, 175, 230

[56] References Cited

U.S. PATENT DOCUMENTS

| | | | |
|---|---|---|---|
| 3,919,795 | 11/1975 | Van Horne Jinivisian et al. | 446/227 X |
| 4,207,696 | 6/1980 | Hyman et al. | 40/473 |
| 4,640,034 | 2/1987 | Zisholtz | 446/227 X |
| 4,810,224 | 3/1989 | DeVincent | 446/175 X |

OTHER PUBLICATIONS

"Dusk to Dawn" Motion Sensor Instruction Manual, 1987, Test Rite Products Corporation, Clifton, N.J. 07012.

*Primary Examiner*—Mickey Yu

*Attorney, Agent, or Firm*—Phillips & Beumer

[57] ABSTRACT

A crib mobile responsive to body motion of an infant. The mobile system is based on use of a passive infrared sensor and associated electrical switching of the type employed for security systems that turn on floodlights in response to detection of the presence of an intruder. An A.C. motor, drive shaft, and support rod for the mobile are mounted on an arm that extends from a housing connectable to a ceiling, and the sensor is mounted on another arm. Electrical connection may be made to a conventional A.C. ceiling outlet. The sensor provides a signal to activate the motor when it detects motion above a predetermined level, and it includes a time delay feature that prevents turning the motor off for a period after such motion is no longer detected. Sensitivity of the sensor and the duration of the time delay are adjustable. The mobile structure includes horizontally extending arms for supporting toys or decorative objects for being rotated in a circular path above a crib. The system provides an educational effect in that an infant learns to control operation of the device by increasing or decreasing its body motion. The system may also include a remotely located sound producing device and a transmitter for remotely turning on the device.

13 Claims, 3 Drawing Sheets

BODY-MOTION ACTIVATED CRIB MOBILE

FIELD OF THE INVENTION

This invention relates generally to crib mobiles and more particularly to crib mobiles that may be turned on in response to activity on the part of an infant.

BACKGROUND OF THE INVENTION

Crib mobiles provide for rotation of decorative items or toys that are suspended above a crib in sight of an infant occupying the crib. These devices typically have a support arm that is connected to a crib by a means such as clamping, a motor-driven rotatable structure supported by the arm, the rotatable structure including means for securing the toys or other objects for rotation in a desired path. Other necessary features have included an electrical power supply such as a battery and a switch for turning the device on and off.

Various arrangements for operation of motor-driven mobiles placed over an infant's crib are disclosed in prior art patents. Many of the prior devices, as exemplified by U.S. Pat. No. 3,919,795, require the attention of another person to turn them on and off. Crib mobiles that may have their motion initiated automatically in response to sound produced by an infant are disclosed is U.S. Pat. Nos. 4,207,696 and 4,640,034. The former of these patents discloses a microphone-activated mobile system that includes energy storing means and a time delay that prevents reactivation during a predetermined period. The latter patent discloses a mode of operation in which motion of the mobile and playing of sound such as a soothing voice or music over a speaker are initiated by detection of sounds that exceed a threshold value.

While sound-activated mobiles provide an educational experience to the infant to the extent that he or she is able to exercise some control over part of the environment, a possibility exists that the baby would misinterpret the control function and decide for itself that crying or loud angry sounds are required to make the mobile operate. Sound activation also would interfere with operation of a cassette or other device to play music or recorded sounds, requiring inclusion of means for establishing the duration of time that such device stays on after having been activated in response to sensed sound. During such period, the baby loses control and the motion of the mobile does not relate directly to the activity level of the baby, thus confusing the educational experience.

Prior mobiles designed to directly attach to a crib present another disadvantage in that batteries would be mandated for safe operation, and the baby would become frustrated when the batteries run down. Clamping and support hardware for this type of mobile also tends to encumber the crib area and interfere with access to the crib.

SUMMARY OF THE INVENTION

The present invention is directed to a crib mobile system including a mobile mounted for being rotated in proximity to a crib, the mobile being activated by a passive infrared sensor that detects body motion of an infant in the crib. When that motion exceeds a predetermined level, the sensor provides a signal to a motor, turning it on and driving the mobile. I have found that a passive infrared sensor used in the manner previously applied for security systems that turn on floodlights in response to the presence of an intruder provides an effective means for activating a crib mobile and that elements of existing security systems of that type may be incorporated into a crib mobile system. In particular, the sensor, mounting hardware, and electrical interconnections for such systems may be readily adapted for use in the present invention. In a preferred embodiment, the support structure for the mobile may be installed as a ceiling fixture and wired to a conventional electrical outlet box. An arm of such fixture, which would otherwise be used for supporting a floodlight, provides necessary mechanical support and electrical connection for rotation of the mobile. Unlike prior devices, the mobile is not supported by being connected to the crib but rather is suspended above it in spaced-apart relation, thus reducing encumbrance of the crib area. Other features which may be employed in combination with the motion-activated mobile include a remote-controlled cassette player or other sound reproducing device and a night light adapted to be switched on when the mobile is activated.

The motion-activated mobile of this invention avoids disadvantages associated with sound-activated systems, in particular, the tendency of an infant to resort to crying or other loud noises to obtain a desired result. In use with the present system, an infant learns instead to associate his or her physical activity level with turning on of the mobile and obtains a beneficial result through experiencing deliberate control over some aspect of its environment. In addition, the capability for ceiling mounting and connection to a ordinary house wiring outlet avoids the need for batteries and for encumbering the crib area with clamped-on support hardware.

It is, therefore, an object of this invention to provide a crib mobile in which motion of the mobile is initiated in response to body motion of an infant in the crib.

Another object is to provide a crib mobile that may be installed on a ceiling above a crib.

Another object is to provide such a mobile that may be operatively connected to a conventional A.C. electrical outlet.

Another object is to provide a crib mobile system that may include a sound-producing device and a night light coupled for activation when the mobile is activated.

Other objects and advantages of the invention will be apparent from the following detailed description and claims.

DESCRIPTION OF THE PREFERRED EMBODIMENT

Figure 1:
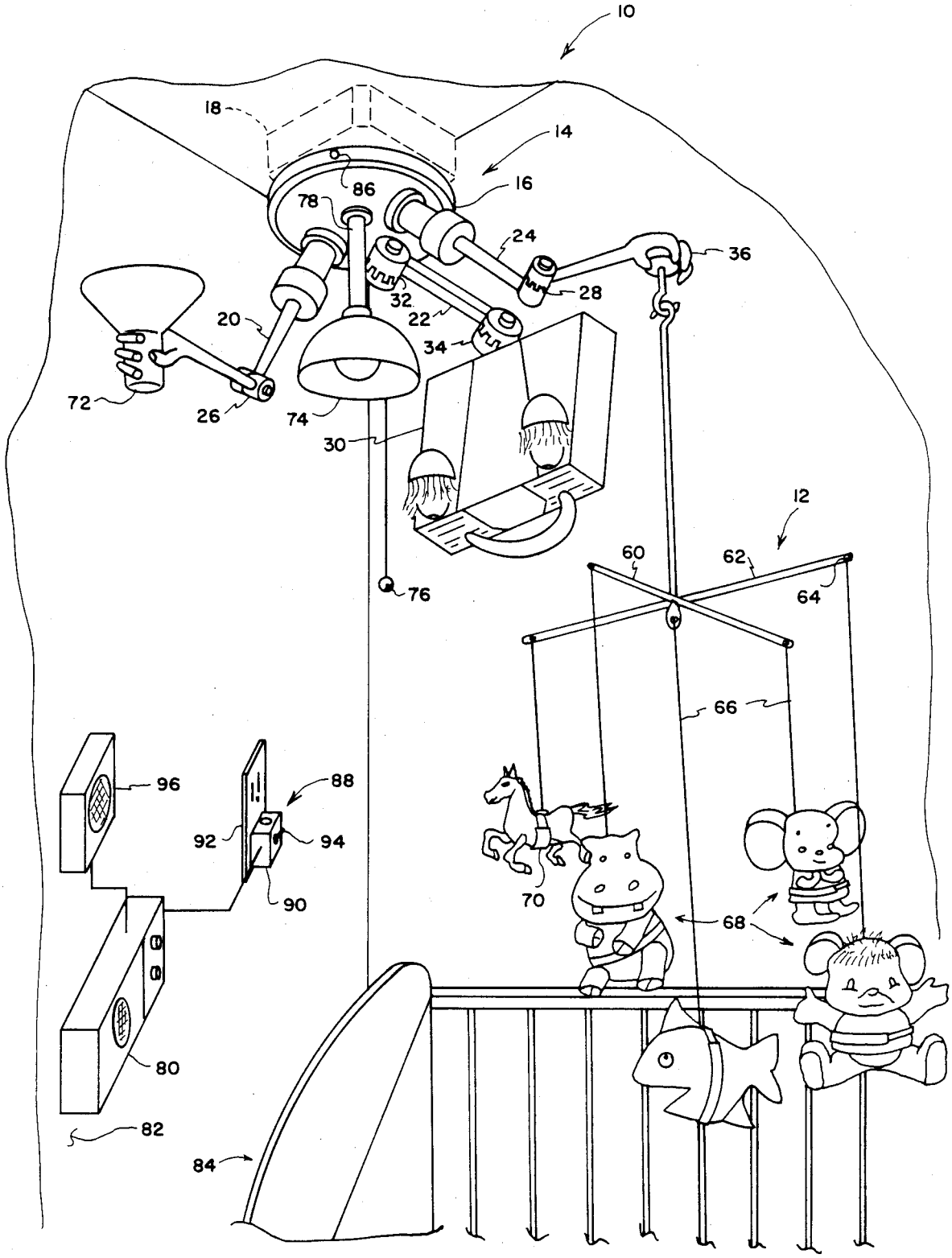
FIG. 1 is a pictorial view of a crib mobile system embodying the invention.

Referring to FIG. 1 of the drawings, there is shown a crib mobile assembly 10 that has a rotatable mobile 12 for placement over a crib in a location such as to enable observation thereof by an infant in a crib. The assembly incorporates elements of a security system 14 as available commercially for the purpose of turning on lights in response to the detection of motion by means of a passive infrared sensor. Such a security system providing these elements is available from Test Rite Product Corporation of Clifton, N.J., under the designation "Dust to Dawn" TM Motion Sensor, Model 0L050G or 0L051G. In particular, the security system has a housing 16 connectable mechanically and electrically to an outlet box 18 and three arms 20, 22, and 24. For its previous use as a intrusion detection system, arms 20 and 24 would support flood lights directed in desired directions by adjustment of the arms around rotatable joints 26 and 28, and arm 22 would support a passive infrared motion sensor 30 adjustable around rotatable joints 32 and 34 for aiming the sensor. The sensor and required wiring for the system would function in the same manner when applied to the present invention, with the sensor being aimed at the crib and its sensitivity being adjusted to a suitable level by means of a sensitivity adjustment feature provided with the sensor.

Figure 2:
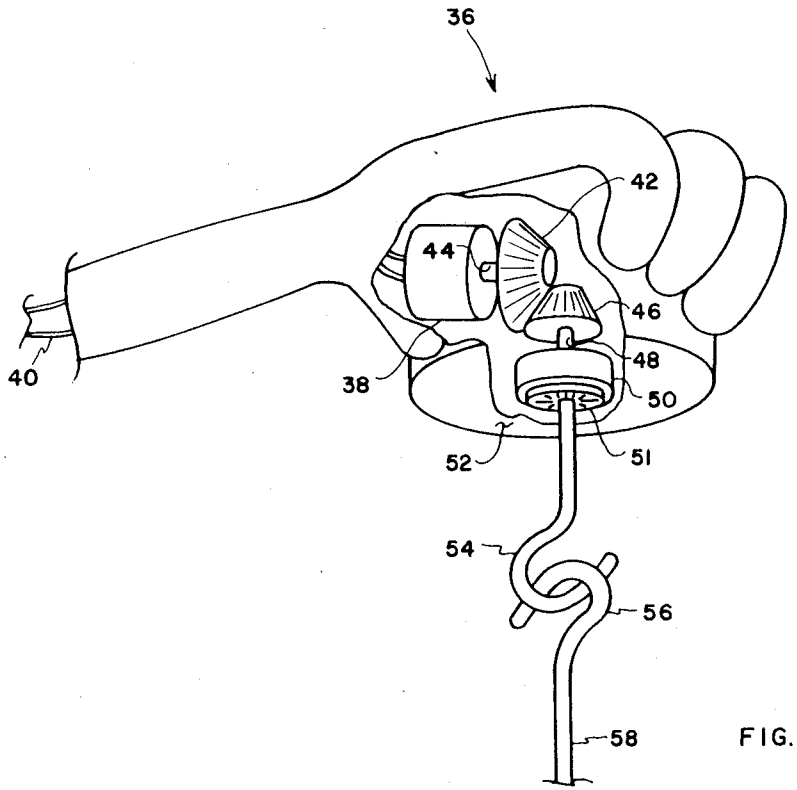
FIG. 2 is an enlarged view, partly broken away, showing the motor and drive means employed.

Arm 24 of the security system is modified by removing the floodlight socket and providing an arm end 36 for supporting an electrical motor 38 connected to wires 40 (FIG. 2) located in the arm for providing current to a floodlight. The motor may be a low rpm motor of the type used for electrical clocks. The motor is coupled to beveled gear 42 by shaft 44, and mating beveled gear 46 is disposed at right angles to gear 42 for driving vertically extending rod 48. A cylindrical support 50 through the center of which rod 48 extends axially, is disposed against bearings 51 that engage housing surface 52 at the bottom of the arm end. Rod 48 terminates in a hook 54 engageable with hook 56 of mobile supporting rod 58. The lower end of rod 58 is connected to a pair of mobile arms 60 and 62 disposed at right angles to one another and having apertures 64 at their ends for engaging strings 66. Toys 68, which may take the form of stuffed animals, are supported by the strings for being moved in a circular path when the motor is turned on. A prefaced means of attaching the toys is to use Velcro TM straps 70 enabling easy interchanging of toys.

A night light 72 may also be included by replacing the floodlight at the end of arm 20 with a low-wattage lamp and aiming it toward the ceiling as indicated. The night light could be operated in the same manner as for the security system, being turned on along with the motor when the sensor is activated or it could be operated by a separate switch (not shown). Room light 74 with a separate pull switch 76 and connected to housing 16 by a conduit 78 may also be included in the system. The room light would preferably be coupled directly to the A.C. current source so as not to be activated by the sensor.

Once the passive motion sensor in the system referred to above is activated by detecting a moving heat source within its sensing area and the motor is turned on in response thereto, the sensor remains activated as long as it continues to detect a moving heat source. When it no longer detects movement, a delay timer to which the sensor is connected kicks in and begins a countdown period to "off." If during this period a moving IR source is again detected, the delay timer resets to the beginning and starts the countdown again. If no movement is detected during the period, the motor will be turned off. This function is included with the passive IR motion sensor security device adapted for use in this embodiment. The length of time for the countdown period is adjustable through a control provided for that purpose.

In order to provide an enhanced amusement effect for an infant, various structural elements may be personified or provided with outward appearances resembling human features. Distal ends of arms 20 and 24 as shown are made to resemble human forearms, wrists, and hands, and the housing for sensor 30 is provided with eyes and other features of the human countenance so as to give the impression of a human face looking toward the infant. Another measure which can be used to prove the effectiveness of the mobile is to incorporate a phosphorescent substance in the toys, causing them to glow for a period of time after all lights are turned off.

FIG. 1 also shows an embodiment wherein a cassette player 80 mounted on a wall 82 near crib 84 is arranged to be turned on when the mobile is activated so a to provide music or other desired sound. Operation of the cassette player is controlled by an infrared transmitter 86 located in the mobile support housing and an infrared receiver 88 electrically coupled to the cassette player. The transmitter and receiver for this purpose may comprise devices of the type widely used for remote control of television sets or VCRs. Transmitter 85 is operably connected to sensor 30 so as to be activated along with motor 38 when motion above a predetermined level is sensed. Receiver 88 is disposed in a housing 90 having interconnections for engaging an A.C. outlet 92 to provide necessary current. A switch 94 is provided to disable this feature if it is desired to operate the mobile without operating the cassette. The cassette player may also be turned off and on separately by means of its own switch. A speaker 96 may be provided as required.

Figure 3:
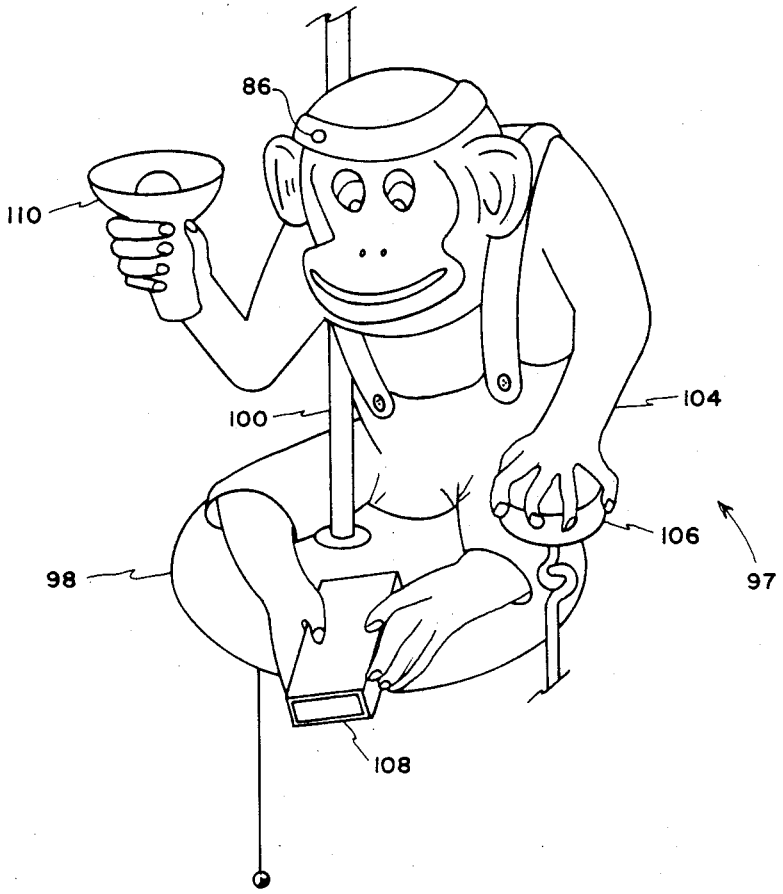
FIG. 3 is a pictorial view of another embodiment.

FIG. 3 shows an embodiment of the invention wherein the functions of the various elements of the mobile system are the same as shown in the preceding figures, but the robot-looking arm structures are replaced by a figure of a monkey 97 perched on a light fixture 98 connected by a conduit 100 to a ceiling box (not shown). One arm 104 supports a motor and drive means (not shown) in a housing 106 secured in the monkey's hand. The infrared sensor 108 and its control are secured between the monkey's feet and the night light 110 is secured by it other arm. This embodiment illustrates a personified version of the system that promotes increased interest and interaction on the part of the infant. Other suitable life forms or fanciful figures, such as a panda bear, elf, fairy, or leprechaun, may also be incorporated in the mobile system.

The mobile system described above serves to enhance an infant's early development. I have observed that an infant quickly learns to control operation of the mobile by deliberately increasing or decreasing its body motion as needed to cause repetition of the previously observed rotating mobile "effect." The cause and effect relationship appears to be quickly learned by even very young babies. The instant, repetitive, and trustworthy reward for the baby's physical effort appears to rapidly reinforce prior learning and, in turn, encourage further participation.

While the invention is described above in terms of specific embodiments, it is not to be understood as so limited but is limited only as indicated by the appended claims.

I claim:

1. A mobile system comprising:

a mobile adapted to be rotated in proximity to a structure holding an infant and in view of the infant;

an electric motor;

drive means operably coupling said motor to said mobile;

means for activating said motor in response to motion of the infant above a predetermined level comprising a passive infrared sensor adapted to provide a signal upon sensing such motion and switching means responsive to said signal and coupled to said motor;

means for connecting said motor and said activating means to a power supply; and means for supporting said mobile;

said system being adapted to enable said infant to deliberately control switching of said motor by increasing or decreasing his or her body motion.

2. A mobile system as defined in claim 1 including time delay means for preventing deactivation of said motor during a predetermined period during which said motion is not sensed.

3. A mobile system as defined in claim 2 wherein said means for supporting said mobile includes a housing connectable to a ceiling.

4. A mobile system as defined in claim 3 wherein said support means includes a plurality of arms connected to and extending downward from said housing.

5. A mobile system as defined in claim 4 wherein said means connecting said motor and activating means to a power supply includes wires suitable for connection to an A.C. outlet.

6. A mobile system as defined in claim 5 including transmitter means arranged to be activated in response to said signal, remotely located receiver means and sound reproducing means coupled to said receiver means whereby said sound reproducing means may be activated in response to transmission of radiant energy by said transmitter.

7. A mobile system as defined in claim 6 wherein said sound reproducing means is a cassette player.

8. A crib mobile system comprising:

a crib mobile adapted to be placed above a crib in view of an infant therein and including a structure for securing a plurality of toys or decorative items for rotation in a predetermined circular path;

an A.C. electric motor;

drive means operably coupling said motor to said mobile for rotation of said mobile;

a passive infrared sensor that may be aimed at the crib for sensing motion of the infant and providing a signal when such motion exceeds a predetermined level;

switching means for activating said motor in response to said signal;

means for connecting said sensor and said electric motor to an A.C. power supply;

means for supporting said mobile; and said system being adapted to enable said infant to deliberately control switching of said motor by increasing or decreasing his of her body motion.

9. A crib mobile system as defined in claim 8 wherein said support means includes a housing connectable to a ceiling and a plurality of arms secured to the housing and extending downward.

10. A crib mobile system as defined in claim 9 wherein said sensor is adjustably mounted at the downward end of one of said arms, and the motor drive means and mobile are mounted on another of said arms.

11. A crib mobile system as defined in claim 10 wherein said crib mobile structure includes a vertically extending rod attachable at its upper end to said drive means and horizontally disposed members including means for securing toys or decorative objects thereto attachable to the lower end of said rod for rotation thereof in a circular path.

12. A crib mobile system as defined in claim 11 including a night light attached to a third arm and adapted to be turned on when said motor is turned on.

13. A crib mobile system as defined in claim 12 including remotely located sound reproducing means and means for remotely turning on the same when said motor is turned on.

* * * * *